US005438966A

United States Patent [19]

Teegen

[11] Patent Number: 5,438,966

[45] Date of Patent: Aug. 8, 1995

[54] FUEL INJECTION NOZZLE WITH ADDITIVE INJECTION FOR DIESEL ENGINES

[75] Inventor: Walter Teegen, Waiblingen, Germany

[73] Assignee: Robert Bosch GmbH, Stuttgart, Germany

[21] Appl. No.: 240,725

[22] PCT Filed: Aug. 20, 1993

[86] PCT No.: PCT/DE93/00755

§ 371 Date: Aug. 19, 1994

§ 102(e) Date: Aug. 19, 1994

[87] PCT Pub. No.: WO94/07020

PCT Pub. Date: Mar. 31, 1994

[30] Foreign Application Priority Data

Sep. 12, 1992 [DE] Germany ..... 42 30 641.8

[51] Int. Cl.[6] ..... F02B 3/00

[52] U.S. Cl. ..... 123/297; 123/304

[58] Field of Search ..... 123/299, 300, 304, 575, 123/472; 251/129.1, 337; 75/12

[56] References Cited

U.S. PATENT DOCUMENTS 4,499,861 2/1985 Wiegand et al. ..... 75/12
4,699,103 10/1987 Tsukahara et al. ..... 123/304
4,864,990 9/1989 Tateishi et al. ..... 123/304
5,163,397 11/1992 Pien ..... 123/299
5,199,398 4/1993 Nylund ..... 123/299
5,217,204 6/1993 Maier et al. ..... 251/337
5,365,902 11/1994 Hsu ..... 123/299

*Primary Examiner*—Raymond A. Nelli
*Attorney, Agent, or Firm*—Edwin E. Greigg; Ronald E. Greigg

[57] ABSTRACT

A fuel injection nozzle for internal combustion engines is arranged for the injection of a quantity of additive between a preinjection quantity and a main injection quantity of the fuel, in order to favorably affect running smoothness and the course of combustion. To assure replicable separation of the quantity of additive from the preinjection quantity and the main injection quantity, the injection nozzle has an intermediate chamber for the liquid additive, located in a nozzle body between a pressure chamber and an antechamber for the main fuel. Throttle gaps separate the intermediate chamber for the antechamber and from the pressure chamber in the closing direction of the valve needle, when a quantity of additive is pumped into the intermediate chamber, the additive positively displaces the main fuel into the pressure chamber. The additive is pumped into the intermediate chamber through an axial inlet conduit and radial bores in the nozzle needle.

7 Claims, 3 Drawing Sheets

Fig. 3
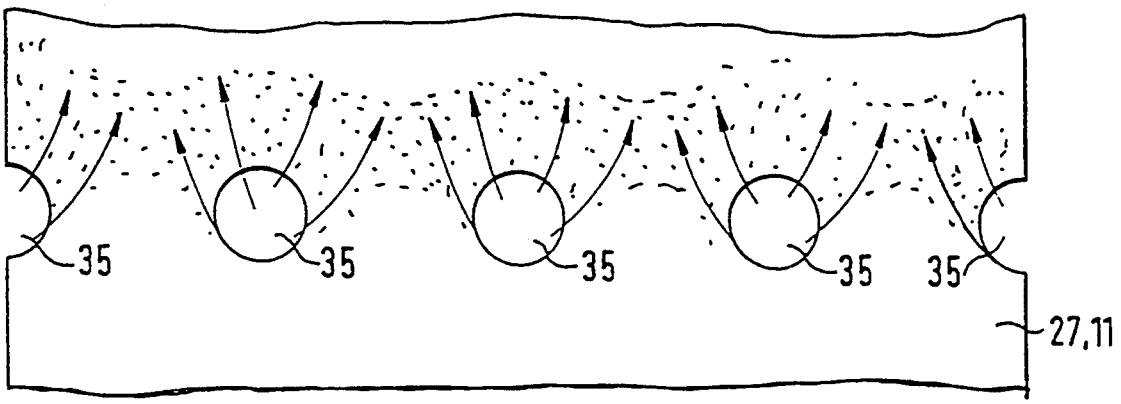
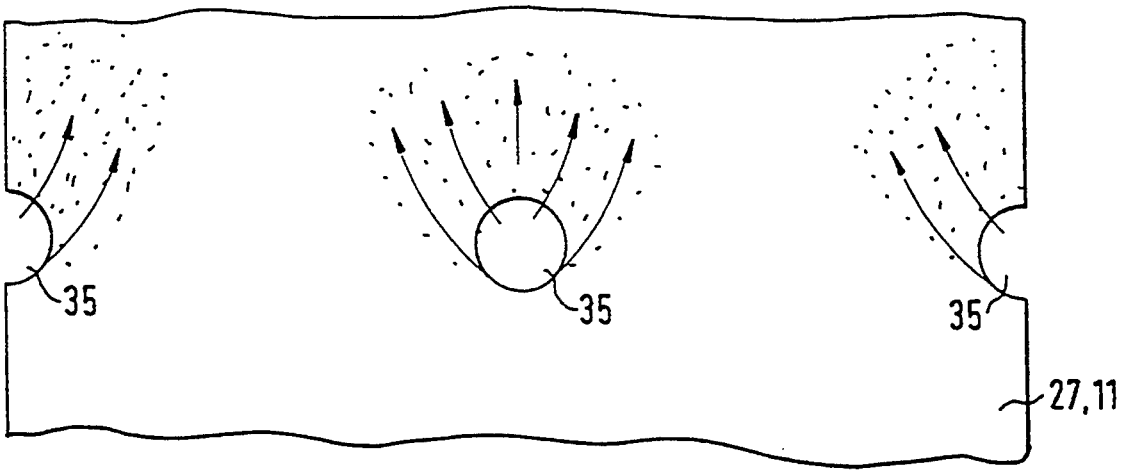
Fig. 4

FUEL INJECTION NOZZLE WITH ADDITIVE INJECTION FOR DIESEL ENGINES

BACKGROUND OF THE INVENTION

The invention relates to a fuel injection nozzle with additive injection for Diesel engines, as generically defined hereinafter. In Diesel engines, in order to vary the course of injection so as, to increase running smoothness and reduce the emission of nitrogen oxides, it is known from German Patent 925 139 to inject the fuel into the combustion chamber in two chronologically separate periods, and to inject an additive, such as water, into the combustion chamber in between the two fuel injections. The known injection nozzle for performing this method has an antechamber to partition off the preinjection quantity and a pressure chamber, into which the inlet conduit for the fuel and the inlet conduit for the additive discharge (FIG. 4), or an annular conduit that joins the additive inlet bore to the fuel inlet bore (FIG. 3). During the injection phase, a quantity of additive is forced into the pressure chamber or into the inlet bore and temporarily stored there. During the injection phase, after positive displacement and injection of the preinjection quantity, the temporarily stored quantity of additive is then injected by fuel pumped at high pressure into the combustion chamber, prior to the injection of the main injection quantity.

An essential feature is that the separation between the injection of the preinjection quantity that initiates ignition, the injection of the additive, and the injection of the main injection quantity be replicable.

ADVANTAGES OF THE INVENTION

The fuel injection nozzle according to the invention has the advantage that the requisite quantity of additive is stored in each operating stroke in the correct layering and injected at the proper time. Its structure and operation are also very simple.

Advantageous further features of the injection nozzles are possible with the provisions recited. In particular, the embodiments according to the invention enables targeted delivery and concentrated temporary storage of the additive in the intermediate chamber. Further, the invention provides for simple manufacture of the antechamber and intermediate chamber.

BRIEF DESCRIPTION OF THE DRAWINGS

An exemplary embodiment of the invention is shown in the drawings and will be described in detail below. Shown are:

FIGS. 3 and 4, a developed view of illustrate a portion of the nozzle needle of FIGS. 1 and 2, in the region of the mouth of the inlet conduit.

DESCRIPTION OF THE EXEMPLARY EMBODIMENT

Figure 1:
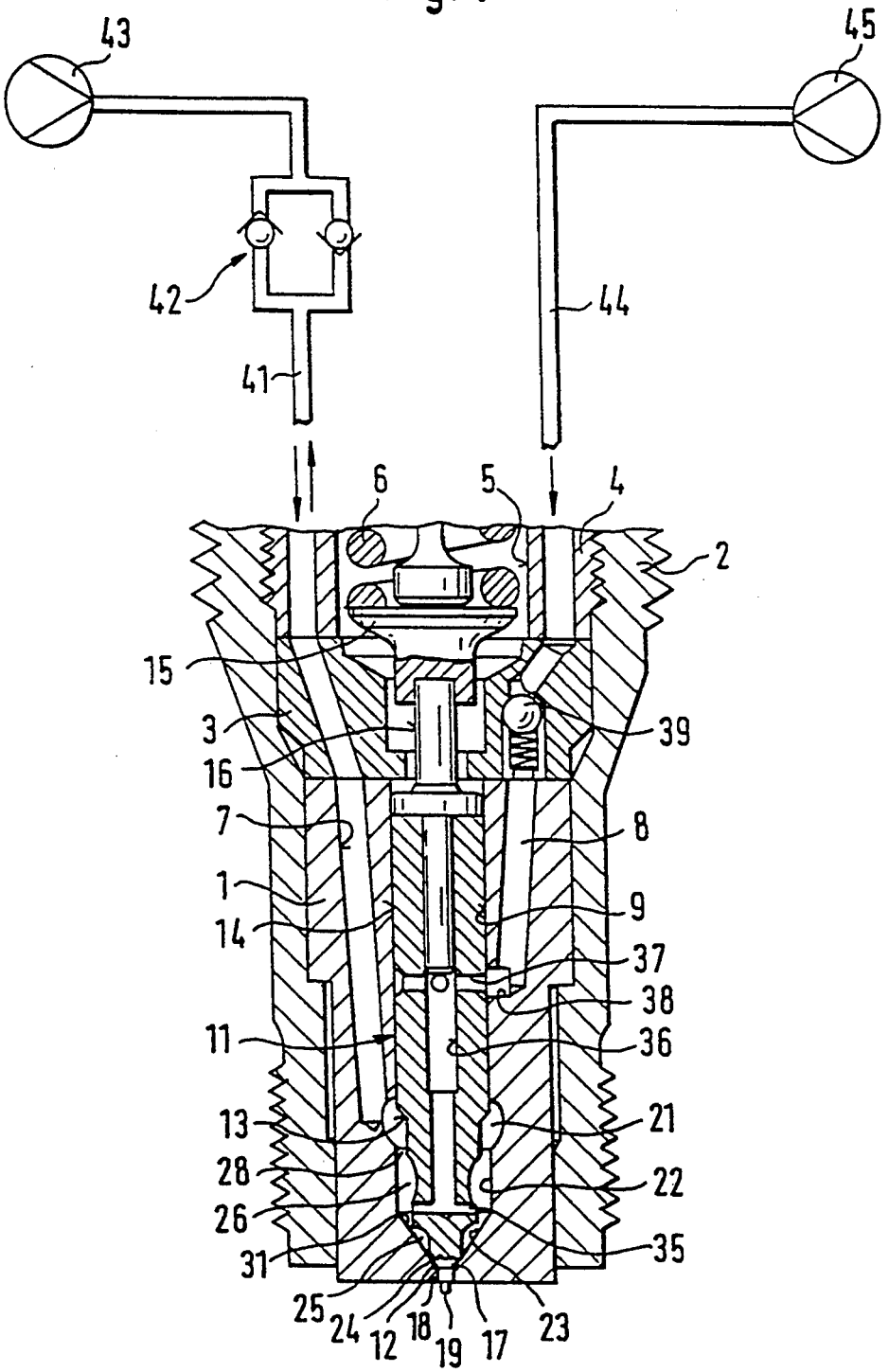
FIG. 1, in axial section, one half of an injection nozzle toward the combustion chamber.

A nozzle body 1 is fastened with a union nut 2, with the interposition of a shim 3, to a nozzle holder 4 (shown only partially), in which a closing spring 6 is disposed in a spring chamber 5. An inlet conduit 7 for the main fuel and an inlet conduit 8 for a liquid additive extend axially inside the nozzle holder 4, the shim 3 and the nozzle body 1. A valve needle 11 is displaceable in a longitudinal bore 9 of the nozzle body 1; it has a closing cone 12 near the end toward the combustion chamber, a pressure shoulder 13 upstream thereof, and a guide portion 14 adjoining the pressure shoulder, and the valve needle is pressed with its closing cone 12 against a conical valve seat 17 on the end of the nozzle body 1 toward the combustion chamber, by the closing spring 6 via a pressure bolt 15 and a pressure tang 16. Next, toward the combustion chamber, is a throttle bore 18, through which a throttle pintle 19 of the valve needle 11 passes. The pressure shoulder 13 of the nozzle needle 11 is surrounded by an annular pressure chamber 21 in the nozzle body 1, into which the inlet bore 7 for the main fuel discharges. Downstream of the pressure chamber, toward the valve seat 17, is an extension cylindrical segment 22 of the longitudinal bore 9, which is adjoined by a conical bore 23, whose portion near the throttle bore 18 forms the valve seat 17.

Upstream of the closing cone 12 of the valve needle 11 that cooperates with the valve seat 17 is a prestorage chamber or antechamber 25, which is formed by an annular recess 24 in the conical nozzle needle tip and is bounded radially on the outside by the conical bore 23. Between the antechamber 25 and the pressure chamber 21, an intermediate chamber 26 is provided, which is radially bounded on the inside by an annular recess 27 in the valve needle 11 and on the outside by the extension segment 22 of the longitudinal bore 9 of the nozzle body 1. In the closing position of the valve needle 11, the intermediate chamber 26 communicates with the pressure chamber 21 via an annular throttle gap 28, which is defined by the end portion 29 of the extension segment 22 near the pressure chamber 21 and by the portion 30 of the shaft of the valve needle 11 near the constriction 27. A throttle gap 31 also connects the intermediate chamber 26 with the antechamber 25, with the throttle gap 31 being formed on the one hand by the transition 32 from the extension segment 22 to the conical bore 23 and on the other by a collar 33 between the annular recess 27 and the recess 24 in the valve needle 11. The two throttle gaps 28 and 31 are essentially operative only in the closing position of the valve needle 11. When the valve needle 11 lifts from the valve seat 17, the faces forming the throttle gaps 28 and 31 shift relative to one another, and the throttling action among the various chambers 21, 26 and 25 is increasingly cancelled out.

A plurality of radial bores 35, preferably four of them, begin at an axial blind bore 36 in the shaft 20 of the valve needle 11 and discharge into the intermediate chamber 26, in a manner that is distributed uniformly over its circumference. The axial bore 36 communicates via transverse bores 37 with a recess 38 in the nozzle body 1, into which the inlet conduit 8 discharges. In the inlet conduit 8, a check valve 39 blocks the return flow of the additive. The first inlet conduit 7 communicates with an injection pump for the main fuel, such as Diesel oil, via a pressure line 41 and a relief valve 42, and the second inlet conduit 8 communicates through an inlet line 44 with a low-pressure pump 45 for the additive, such as water.

Figure 2:
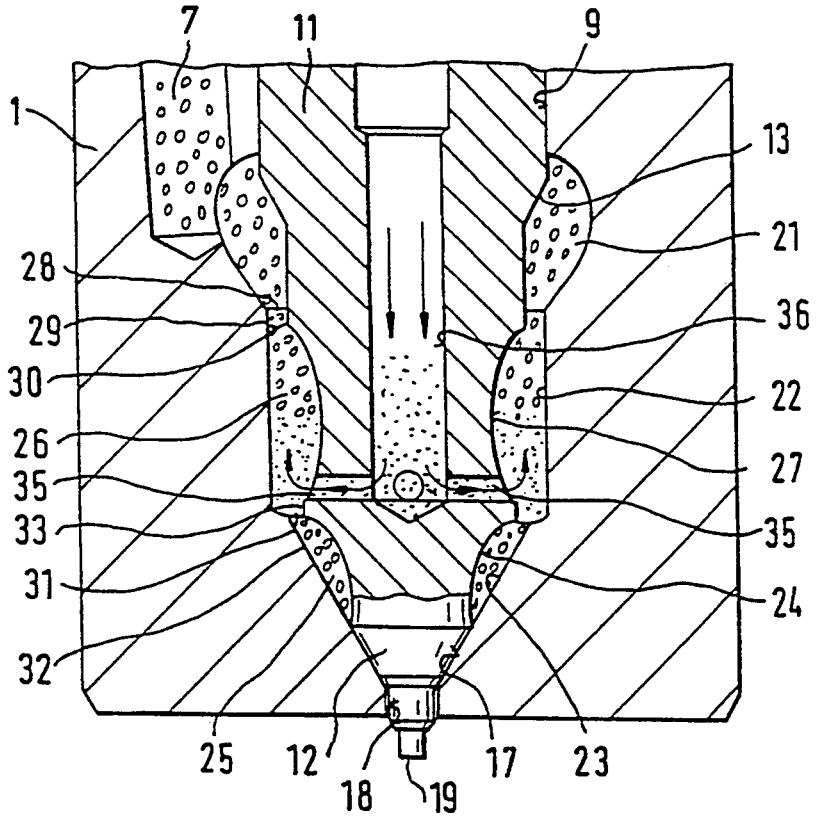
FIG. 2, in axial section on a larger scale, a portion of the injection nozzle toward the combustion chamber of the nozzle body and valve needle of the injection nozzle of FIG. 1.

The injection nozzle described functions as follows:

After each injection phase, when the valve needle 11 is again in the closed position, the pressure chamber 21, intermediate chamber 26 and antechamber 25 are filled with from the mainline 7 fuel. The preinjection quantity is defined by the volume of the antechamber 25, and this volume is adapted to the technical combustion requirements of the particular engine. Between each two injection phases, a small predetermined quantity of liquid additive is metered out by the low-pressure pump 45 and pumped through the inlet conduit 8, the transverse bores 37, axial bore 36 and radial bores 35 into the intermediate chamber 26. The inflowing quantity of additive positively displaces the main fuel, still remaining there from the prior injection phase, into the pressure chamber 21 counter to the flow direction. The throttle gap 31 reinforces the separate preservation of a prestored quantity of fuel, which is needed as an ignition quantity, in the antechamber 25, and the throttle gap 28 promotes circumferentially distributed storage of the metered quantity of additive (FIG. 2). The reverse positive displacement of the main fuel is enabled by the relief valve 42. In the ensuing buildup of the requisite injection pressure for a new injection phase by the injection pump 43, the throttle gap 28 also acts upon the resultant compression flow, in that better distribution of the main fuel in the pressure chamber 21 takes place first, before the opening pressure is reached. When the valve needle 11 lifts from the valve seat 17, the two throttle gaps 28 and 31 lose their effect, so that an unhindered scavenging flow results, first the preinjection quantity prestored in the antechamber 25 and then the quantity of additive temporarily stored in the intermediate chamber 26 is injected into the combustion region of the engine, before injection of the main fuel quantity ensues.

As FIGS. 3 and 4 show, by providing a more or less large number of radial bores 35 discharging into the pressure chamber 26 and thus varying the spacing among the individual radial bores 35 through which the additive flows into the intermediate chamber 26, it is possible to form an intermediate layer of additive that is closed all the way around (FIG. 3), or to incorporate separate small quantities into the main fuel (FIG. 4). In the latter case, the result in the intermediate chamber 26 is a quantity of additive and fuel that mixes intensively upon injection. One version or the other will be chosen, depending on the requirements of the engine.

The invention is described in terms of a so-called throttle pintle injection nozzle, in which a pintle on the valve needle protrudes into the injection port. It can also be employed with so-called hole-type nozzles, in which injection streams are shaped in injection ports whose cross section is small.

The foregoing relates to a preferred exemplary embodiment of the invention, it being understood that other variants and embodiments thereof are possible within the spirit and scope of the invention, the latter being defined by the appended claims.

I claim:

1. A fuel injection nozzle for internal combustion engines with additional injection of an additive between a preinjection and a main injection of the fuel, comprising a nozzle body in which a valve seat is formed in an end portion toward the combustion chamber and a pressure chamber is formed upstream thereof; a valve needle is displaceably supported in the nozzle body and urged in a closing direction, said valve needle has a sealing seat (12), which cooperates with the valve seat (17), and a pressure shoulder (13) at a level of the pressure chamber; an antechamber (25), disposed between the valve seat and the pressure chamber (21), for prestoring a preinjection quantity; and having an inlet conduit (7) for the fuel leading to the pressure chamber and an inlet conduit (8) for an additive for temporary storage of a quantity of additive between the preinjection quantity and the main injection quantity, an intermediate chamber (26) is disposed in the flow direction between the pressure chamber (21) and the antechamber (25), said intermediate chamber is made to communicate, via openable throttle restrictions (28, 31), with the pressure chamber (21) and the antechamber (25) for the flow therethrough of the main injection quantity, and the additive discharges into the intermediate chamber via the inlet conduit (8).

2. A fuel injection nozzle as defined by claim 1, in which the inlet conduit (8) for the additive is disposed partly in the valve needle (11) and discharges through radial bores (35) into the intermediate chamber (26).

3. A fuel injection nozzle as defined by claim 2, in which the intermediate chamber (26) is bounded radially by a constriction (27) on the valve needle (11) and by a cylindrical bore portion (22) in the nozzle body (1).

4. A fuel injection nozzle as defined by claim 1, in which the antechamber (25) and the intermediate chamber (26) are formed by annular recesses (27, 24) in the circumference of the nozzle needle (11) and are separated from one another by a collar (33), whose circumference defines a throttle restriction (31).

5. A fuel injection nozzle as defined by claim 2, in which the antechamber (25) and the intermediate chamber (26) are formed by annular recesses (27, 24) in the circumference of the nozzle needle (11) and are separated from one another by a collar (33), whose circumference defines a throttle restriction (31).

6. A fuel injection nozzle as defined by claim 3, in which the antechamber (25) and the intermediate chamber (26) are formed by annular recesses (27, 24) in the circumference of the nozzle needle (11) and are separated from one another by a collar (33), whose circumference defines a throttle restriction (31).

7. A fuel injection nozzle as defined by claim 4, in which the radial bores (35) in the nozzle needle (11) discharge into the intermediate chamber (26) near the collar (33).

* * * * *